US011367405B2

(12) United States Patent
Gao

(10) Patent No.: US 11,367,405 B2
(45) Date of Patent: Jun. 21, 2022

(54) SPLICED DISPLAY PANEL AND METHOD OF COMPENSATING SPLICED DISPLAY PANEL FOR MURA PHENOMENON

(71) Applicant: TCL CHINA STAR OPTOELECTRONICS TECHNOLOGY CO., LTD., Shenzhen (CN)

(72) Inventor: Xiang Gao, Shenzhen (CN)

( * ) Notice: Subject to any disclaimer, the term of this patent is extended or adjusted under 35 U.S.C. 154(b) by 261 days.

(21) Appl. No.: 16/639,588

(22) PCT Filed: Jan. 7, 2020

(86) PCT No.: PCT/CN2020/070569

§ 371 (c)(1),
(2) Date: Feb. 17, 2020

(87) PCT Pub. No.: WO2021/128461

PCT Pub. Date: Jul. 1, 2021

(65) Prior Publication Data

US 2022/0005426 A1 Jan. 6, 2022

(30) Foreign Application Priority Data

Dec. 24, 2019 (CN) ..... 20191135123.6

(51) Int. Cl.
*G09G 3/36* (2006.01)

(52) U.S. Cl.
CPC ... *G09G 3/3607* (2013.01); *G09G 2320/0233* (2013.01); *G09G 2320/0271* (2013.01)

(58) Field of Classification Search
CPC ..... G09G 3/3607; G09G 2320/0233; G09G 2320/0271
See application file for complete search history.

(56) References Cited

U.S. PATENT DOCUMENTS

| | | | | |
|---|---|---|---|---|
| 2014/0184658 | A1 | 7/2014 | Wang | |
| 2015/0187289 | A1* | 7/2015 | Kim | G09G 3/3644 345/89 |
| 2017/0206821 | A1 | 7/2017 | Lee et al. | |
| 2017/0243562 | A1* | 8/2017 | Hu | G09G 5/10 |
| 2018/0234639 | A1 | 8/2018 | Kim et al. | |
| 2018/0322833 | A1* | 11/2018 | Zhang | G09G 3/3607 |
| 2018/0322834 | A1 | 11/2018 | Zhang | |

FOREIGN PATENT DOCUMENTS

| | | | |
|---|---|---|---|
| CN | 106910483 | A | 6/2017 |
| CN | 107290909 | A | 10/2017 |
| CN | 109920360 | A | 6/2019 |
| TW | 201426689 | A | 7/2014 |

* cited by examiner

*Primary Examiner* — Kwang-Su Yang

(57) ABSTRACT

A spliced display panel and a method of compensating the spliced display panel for a mura phenomenon are disclosed. In the method, secondary compensation values are obtained through a secondary compensation formula and initial compensation values in order to compensate spliced regions of the spliced display panel for the second time.

7 Claims, 5 Drawing Sheets

SPLICED DISPLAY PANEL AND METHOD OF COMPENSATING SPLICED DISPLAY PANEL FOR MURA PHENOMENON

BACKGROUND OF DISCLOSURE

1. Field of Disclosure

The present disclosure relates to the field of display technology, and more particularly, to a spliced display panel and a method of compensating a spliced display panel for a mura phenomenon.

2. Description of Related Art

With the evolution of optoelectronics and semiconductor technology, flat panel displays have also evolved. In many flat panel displays, liquid crystal displays (LCDs) have been applied to all aspects of production and life because of their advantages of high space utilization efficiency, low power consumption, no radiation, low electromagnetic interference, etc.

Uneven brightness of LCD panels is sometimes caused by process deficiencies in batch production of the LCD panels, so that various mura (i.e., bright or dark marks) is formed. Currently, each display panel is compensated for a mura phenomenon in production lines of the LCD panels in order to solve the problem, thereby causing the LCD panels to have uniform brightness.

However, due to instability of conventional spliced display panels in manufacturing processes, split-screen mura bounded by a spliced place is prone to occur, and a mutation phenomenon exists. Each of spliced display panels has a mura phenomenon with different severity, and it cannot be compensated well in conventional processes.

SUMMARY

A technical problem is that inconsistent display due to difficulty for eliminating a mura phenomenon at a spliced place of a spliced display panel, so that the present disclosure provides a spliced display panel and a method of compensating a spliced display panel for a mura phenomenon to solve a technical problem of affecting display effects in conventional technologies.

A technical solution is that the present disclosure provides a spliced display panel and a method of compensating a spliced display panel for a mura phenomenon, which can compensate a spliced place of the spliced display panel for a mura phenomenon and improve display uniformity of the spliced place and display effects of the spliced display panel.

An embodiment of the present disclosure provides a method of compensating a spliced display panel for a mura phenomenon, the method including: defining a plurality of partitions, each of which has n columns and m rows of pixels, where n and m are equal to 4 or are multiples of 4, acquiring an initial compensation value for each of the pixels through a measuring device, and storing an initial compensation value for a first pixel in each of the plurality of partitions; for the each of the plurality of partitions, computing initial compensation values for the pixels except the first pixel by linear interpolation according to initial compensation values for first pixels in adjacent partitions, and compensating the plurality of partitions for a mura phenomenon; acquiring initial compensation values for pixels in a plurality of spliced partitions, which are disposed close to two sides of a spliced line of the spliced display panel; and obtaining secondary compensation values for the pixels in the plurality of spliced partitions according to a secondary compensation formula and the initial compensation values for the pixels in the plurality of spliced partitions in order to compensate the plurality of spliced partitions for a mura phenomenon for the second time.

In an embodiment of the present disclosure, multiple rows of pixels are arranged along a direction vertical to the spliced line in each of the plurality of spliced partitions, each row of pixels corresponds to a central value which is an initial compensation value for a pixel located in the each row of pixels and in the middle of the each of the plurality of spliced partitions, and for the each row of pixels, the secondary compensation formula includes the central value to which the each row of pixels corresponds.

In an embodiment of the present disclosure, a secondary compensation value for the each row of pixels is obtained by a corresponding central value according to the secondary compensation formula.

In an embodiment of the present disclosure, when the central value is an even number, the secondary compensation formula is represented by: Z/2, where "Z" represents the central value.

In an embodiment of the present disclosure, when the central value is an odd number and is greater than zero, the secondary compensation formula is represented by: (Z+1)/2, where "Z" represents the central value.

In an embodiment of the present disclosure, when the central value is an odd number and is less than zero, the secondary compensation formula is represented by: (Z−1)/2, where "Z" represents the central value.

In an embodiment of the present disclosure, the central value is an initial compensation value for any of two middle pixels in a corresponding row of pixels.

In an embodiment of the present disclosure, n is equal to m.

According to an object of the present disclosure, what is provided is a spliced display panel, including a storage unit, a compute-and-compensate unit, an acquiring unit, a computing unit, and a compensating unit. The storage unit is configured to compress a plurality of partitions, each of which has n columns and m rows of pixels, where n and m are equal to 4 or are multiples of 4, and configured to store an initial compensation value for a first pixel in each of the plurality of partitions. The compute-and-compensate unit is configured to compute, for the each of the plurality of partitions, initial compensation values for the pixels except the first pixel by linear interpolation according to initial compensation values for first pixels in adjacent partitions, and configured to compensate the spliced display panel for a mura phenomenon. The acquiring unit is configured to acquire initial compensation values for a plurality of spliced partitions, which are disposed close to two sides of a spliced line of the spliced display panel. The computing unit is configured to obtain secondary compensation values for the plurality of spliced partitions according to a secondary compensation formula and the initial compensation values for the plurality of spliced partitions. The compensating unit is configured to compensate the plurality of spliced partitions for a mura phenomenon for the second time according to the secondary compensation values.

In an embodiment of the present disclosure, the spliced display panel consists of a plurality of liquid crystal display panels spliced together.

In an embodiment of the present disclosure, multiple rows of pixels are arranged along a direction vertical to the spliced line in each of the plurality of spliced partitions, each row of pixels corresponds to a central value which is an initial compensation value for a pixel located in the each row of pixels and in the middle of the each of the plurality of spliced partitions, and for the each row of pixels, the secondary compensation formula includes the central value to which the each row of pixels corresponds.

In an embodiment of the present disclosure, a secondary compensation value for the each row of pixels is obtained by a corresponding central value according to the secondary compensation formula.

In an embodiment of the present disclosure, when the central value is an even number, the secondary compensation formula is represented by: Z/2, where "Z" represents the central value.

In an embodiment of the present disclosure, when the central value is an odd number and is greater than zero, the secondary compensation formula is represented by: (Z+1)/2, where "Z" represents the central value.

In an embodiment of the present disclosure, when the central value is an odd number and is less than zero, the secondary compensation formula is represented by: (Z−1)/2, where "Z" represents the central value.

In an embodiment of the present disclosure, the central value is an initial compensation value for any of two middle pixels in a corresponding row of pixels.

In an embodiment of the present disclosure, n is equal to m.

The beneficial effect of the present disclosure is that, relative to conventional technologies, the present disclosure provides a spliced display panel and a method of compensating a spliced display panel for a mura phenomenon. After the spliced display panel is compensated for a mura phenomenon, pixels on two sides of a spliced line of the spliced display panel are compensated for the second time according to a secondary compensation formula and initial compensation values in order to improve display uniformity of a spliced place, a mura phenomenon in the spliced display panel, and display effects of the spliced display panel.

BRIEF DESCRIPTION OF DRAWINGS

In order that the technical solutions and other beneficial effects of the present disclosure are apparent and easy to understand, specific embodiments of the present disclosure are described in conjunction with the accompanying drawings in detail below.

DETAILED DESCRIPTION OF EMBODIMENTS

Figure 1:
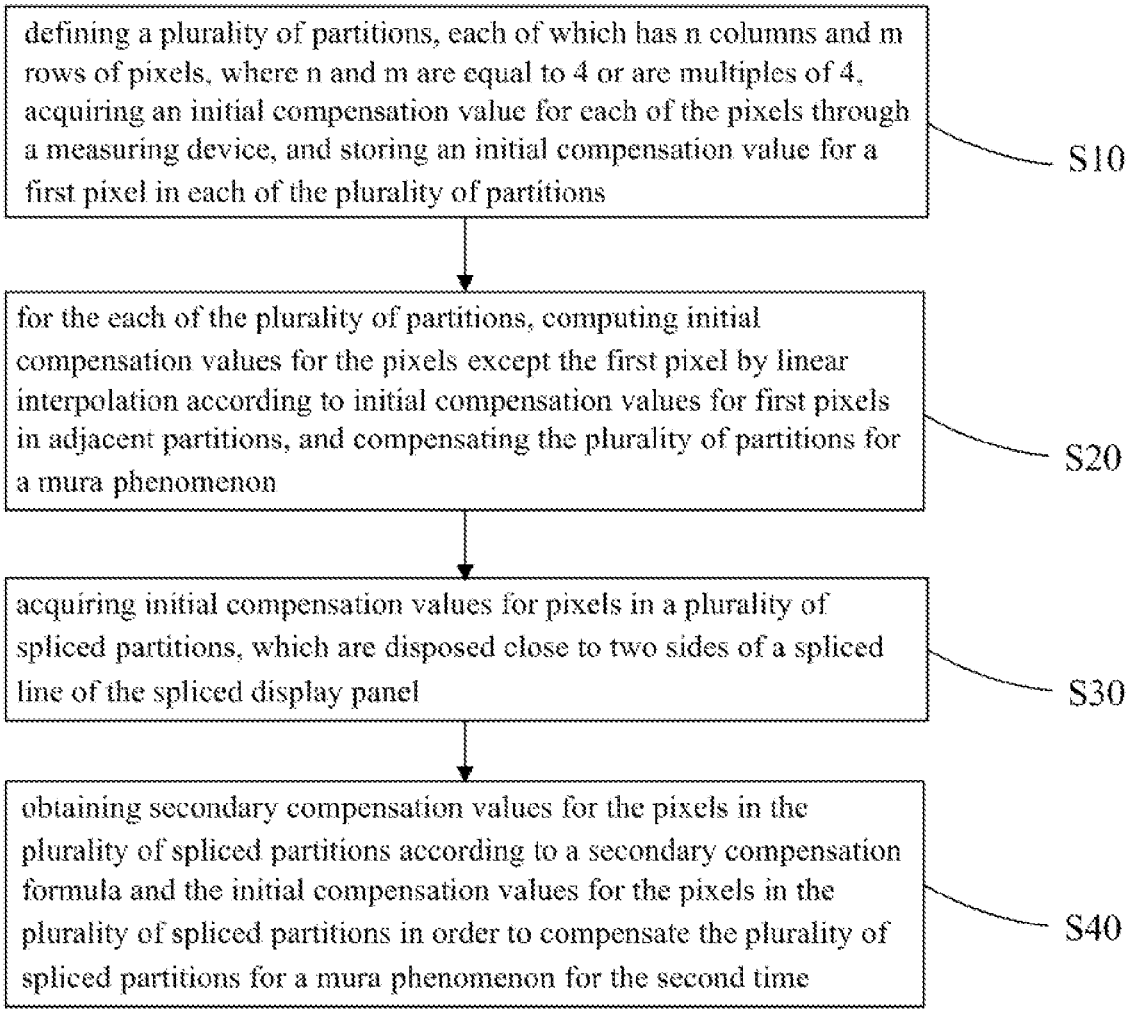
FIG. 1 is a flowchart illustrating a method of compensating a spliced display panel for a mura phenomenon according to an embodiment of the present disclosure.

For the embodiments of the present disclosure, their technical solutions will be described clearly and completely in conjunction with their accompanying drawings below. It is obvious that the embodiments described herein are merely a part of the embodiments of the present disclosure instead of all of the embodiments. A person having ordinary skill in this field can obtain other embodiments according to the embodiments of the present disclosure under the premise of not paying creative works, and all of these embodiments should be within the protective scope of the present disclosure.

In the description of the present disclosure, it should be understood that terms such as "center", "longitudinal", "lateral", "length", "width", "thickness", "upper", "lower", "front", "rear", "left", "right", "vertical", "horizontal", "top", "bottom", "inside", "outside", "clockwise", "counterclockwise" as well as derivative thereof should be construed to refer to the orientation as then described or as shown in the drawings under discussion. These relative terms are for convenience of description, do not require that the present disclosure be constructed or operated in a particular orientation, and shall not be construed as causing limitations to the present disclosure. In addition, terms such as "first" and "second" are used herein for purposes of description and are not intended to indicate or imply relative importance or a quantity of features. Thus, features limited by "first" and "second" are intended to indicate or imply including one or more than one these features. In the description of the present disclosure, "a plurality of" relates to two or more than two, unless otherwise specified.

In the description of the present disclosure, unless specified or limited otherwise, it should be noted that, terms "mounted", "interconnected" and "connected" may be understood broadly, such as permanent connection or detachable connection or integral connection, mechanical connection or electronic connection or mutual communication, direct connection or indirect connection via intermediary, inner communication or interaction between two elements. A person skilled in the art should understand the specific meanings in the present disclosure according to specific situations.

In the description of the present disclosure, unless specified or limited otherwise, it should be noted that, a structure in which a first feature is "on" or "beneath" a second feature may include an embodiment in which the first feature directly contacts the second feature, and may also include an embodiment in which an additional feature is formed between the first feature and the second feature so that the first feature does not directly contact the second feature. Furthermore, a first feature "on", "above", or "on top of" a second feature may include an embodiment in which the first feature is right "on", "above", or "on top of" the second feature, and may also include an embodiment in which the first feature is not right "on", "above", or "on top of" the second feature, or just means that the first feature has a sea level elevation greater than the sea level elevation of the second feature. While first feature "beneath", "below", or "on bottom of" a second feature may include an embodiment in which the first feature is right "beneath", "below", or "on bottom of" the second feature, and may also include an embodiment in which the first feature is not right "beneath", "below", or "on bottom of" the second feature, or just means that the first feature has a sea level elevation less than the sea level elevation of the second feature.

The following description provides various embodiments or examples for implementing various structures of the present disclosure. To simplify the description of the present disclosure, parts and settings of specific examples are described as follows. Certainly, they are only illustrative, and are not intended to limit the present disclosure. Further, reference numerals and reference letters may be repeated in different examples. This repetition is for purposes of simplicity and clarity and does not indicate a relationship of the various embodiments and/or the settings. Furthermore, the present disclosure provides specific examples of various processes and materials, however, a person skilled in the art may be aware of applications of other processes and/or other materials.

For conventional spliced display panels, due to their instability in manufacturing processes, split-screen mura bounded by a spliced place is prone to occur. However, conventional processes fail to provide good compensating effects.

For the above technical problem, the present disclosure provides a method of compensating a spliced display panel for a mura phenomenon, the method including:

defining a plurality of partitions, each of which has n columns and m rows of pixels, where n and m are equal to 4 or are multiples of 4, acquiring an initial compensation value for each of the pixels through a measuring device, and storing an initial compensation value for a first pixel in each of the plurality of partitions;

for the each of the plurality of partitions, computing initial compensation values for the pixels except the first pixel by linear interpolation according to initial compensation values for first pixels in adjacent partitions, and compensating the plurality of partitions for a mura phenomenon;

acquiring initial compensation values for pixels in a plurality of spliced partitions, which are disposed close to two sides of a spliced line of the spliced display panel; and obtaining secondary compensation values for the pixels in the plurality of spliced partitions according to a secondary compensation formula and the initial compensation values for the pixels in the plurality of spliced partitions in order to compensate the plurality of spliced partitions for a mura phenomenon for the second time.

In the course of implementation and application, due to instability of conventional spliced display panels in manufacturing processes, split-screen mura bounded by a spliced place is prone to occur, and a mutation phenomenon exists. Each of spliced display panels has a mura phenomenon with different severity, and it cannot be compensated well in conventional processes. However, a method of compensating a spliced display panel for a mura phenomenon provided in an embodiment of the present disclosure acquires secondary compensation values through a secondary compensation formula, which can effectively provide a second grayscale data compensation for spliced regions to improve uniformity of display brightness of the spliced display panel, display effects, and product quality.

Specifically, please refer to FIG. 1, which is a method of compensating a spliced display panel for a mura phenomenon according to an embodiment of the present disclosure. The method includes:

Step S10: defining a plurality of partitions, each of which has n columns and m rows of pixels, where n and m are equal to 4 or are multiples of 4, acquiring an initial compensation value for each of the pixels through a measuring device, and storing an initial compensation value for a first pixel in each of the plurality of partitions.

In an embodiment of the present disclosure, for example, n is equal to m, and n is, but not limited to, 8.

Step S20: for the each of the plurality of partitions, computing initial compensation values for the pixels except the first pixel by linear interpolation according to initial compensation values for first pixels in adjacent partitions, and compensating the plurality of partitions for a mura phenomenon.

In an embodiment of the present disclosure, the course of the linear interpolation is as follows: a mura form with a grayscale picture (i.e., pure white picture with different brightness) can be photographed through an outboard camera. Computing a brightness difference between the surrounding regions and a central position by comparing the brightness of the central position of the spliced display panel. Then, reversely compensating a mura place for a grayscale, that is, lowering grayscale of regions brighter than the central position to reduce brightness, and heightening grayscale of regions darker than the central position to increase brightness, so that the overall spliced display panel can reach a relatively consistent brightness.

Generally, reverse compensating data is stored in a flash memory. Also, in order to reduce design costs, the flash memory does not store grayscale compensating data for each pixel. Instead, a plurality of partitions are formed by compressing the grayscale compensating data with a region interval having n columns and m rows of pixels (e.g. 8 columns and 8 rows of pixels), and only grayscale compensating data (i.e., an initial compensation value cited below) for a first pixel in each partition is stored in the flash memory. In addition, initial compensation values for other pixels in each partition are computed by linear interpolation.

Figure 4:
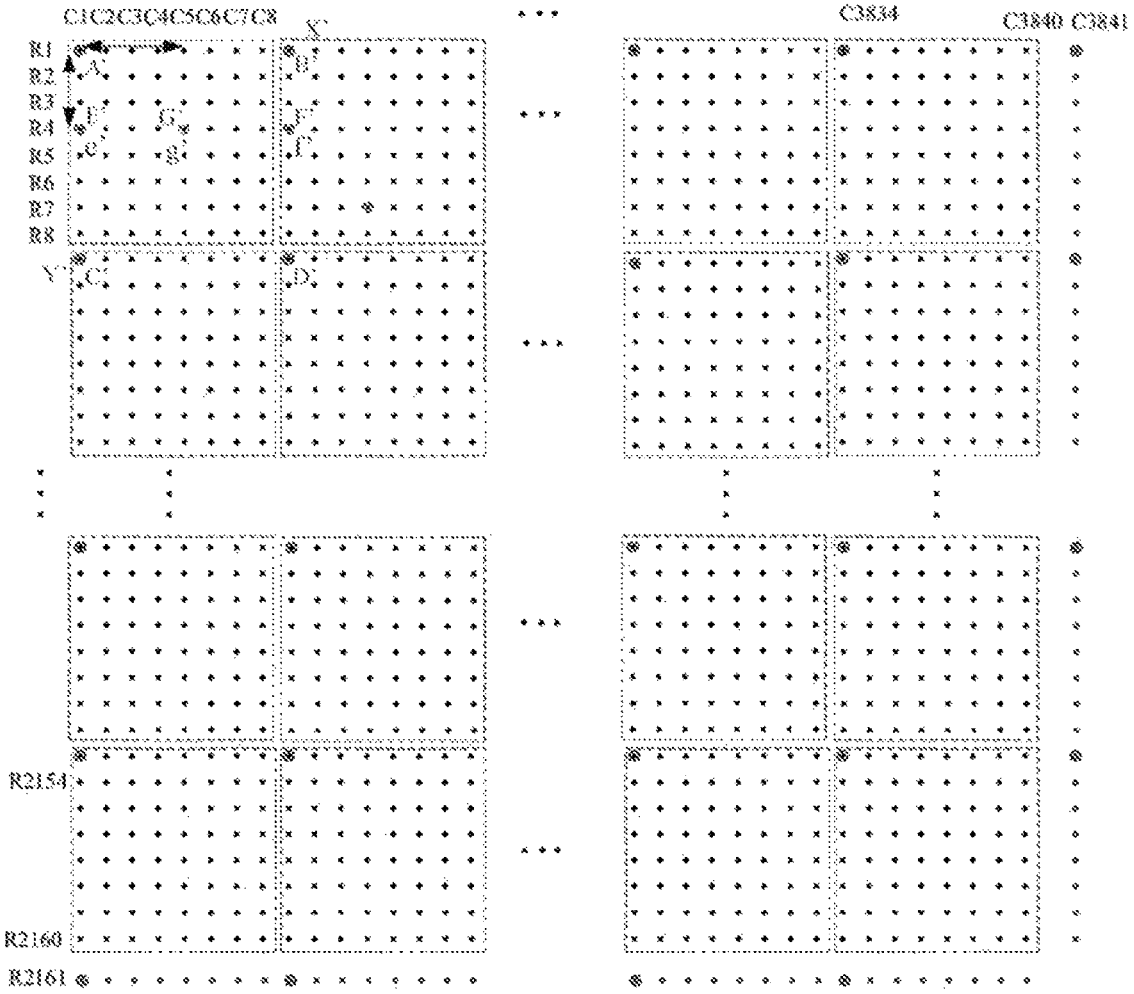
FIG. 4 is a schematic diagram of data compensation using linear interpolation according to an embodiment of the present disclosure.

Please refer to FIG. 4, taking an ultra-high definition (UHD) differential display panel having 3840 columns and 2160 rows of pixels as an example, 480 columns and 270 rows of partitions are formed by compressing with an interval having 8 columns and 8 rows of pixels, wherein one region is formed by a square dotted line, as shown in the figure. An initial compensation value for a pixel (which is circled) corresponding to the intersection of the i-th row of pixels and the j-th column of pixels is stored in a data storage (e.g. flash memory), where i=1, 9, 17, . . . , 2145, 2153, and j=1, 9, 17, . . . , 3825, 3833. That is, 480×270 initial compensation values in total are stored. In addition, in order to compute initial compensation values for the 3834th to 3840th column of pixels and initial compensation values for the 2154th to 2160th row of pixels, 270 initial compensation values for the 3841th column of pixels (i.e., a virtual pixel circled in the figure) is computed by the stored initial compensation values for the 3825th and the 3833th column of pixels, and 480 initial compensation values for the 2161th row of pixels (i.e., a virtual pixel circled in the figure) is computed by the initial compensation values for the 2145th and the 2153th row of pixels. Thus, 481×271 initial compensation values in total need to be stored in the data storage, and initial compensation values for the rest of the pixels are computed by a timing controller (i.e., Tcon IC) through linear interpolation according to the existing 481×271 initial compensation values.

Please continue to refer to FIG. 4, a specific computing method for the rest of the pixels is as follows: taking a partition formed by the 1st to 8th rows and the 1st to 8th columns of pixels as an example, it is known that in the region, an initial compensation value for a pixel (i.e., the pixel on the upper left corner) corresponding to the intersection of the 1st row of pixels and the 1st column of pixels is A', an initial compensation value for a pixel corresponding to the intersection of the 1st row of pixels and the 9th column of pixels is B', an initial compensation value for a pixel corresponding to the intersection of the 9th row of pixels and the 1st column of pixels is C', and an initial compensation value for a pixel corresponding to the intersection of the 9th row of pixels and the 9th column of pixels is D'. The initial compensation values A', B', C', and D' are known, and through linear interpolation, initial compensation values E', F', and G' respectively corresponding to pixels e', f', and g' are computed by:

$$E'=[(8-Y')*A'+Y'*C']/8;$$

$$F'=[(8-Y')*B'+Y'*D']/8; \text{ and}$$

$$G'=[(8-X')*E'+X'*F']/8,$$

where X' is a number of intervals of row-pixels between a corresponding pixel and the pixel corresponding to the intersection of the 1st row of pixels and the 1st column of pixels, and Y' is a number of intervals of column-pixels between a corresponding pixel and the pixel corresponding to the intersection of the 1st row of pixels and the 1st column of pixels.

In conclusion, the initial compensation values for all of the pixels in the spliced display panel can be computed through linear interpolation in an embodiment of the present disclosure, and the spliced display panel is compensated for a mura phenomenon.

Step S30: acquiring initial compensation values for pixels in a plurality of spliced partitions, which are disposed close to two sides of a spliced line of the spliced display panel; and Step S40: obtaining secondary compensation values for the pixels in the plurality of spliced partitions according to a secondary compensation formula and the initial compensation values for the pixels in the plurality of spliced partitions in order to compensate the plurality of spliced partitions for a mura phenomenon for the second time.

Figure 2:
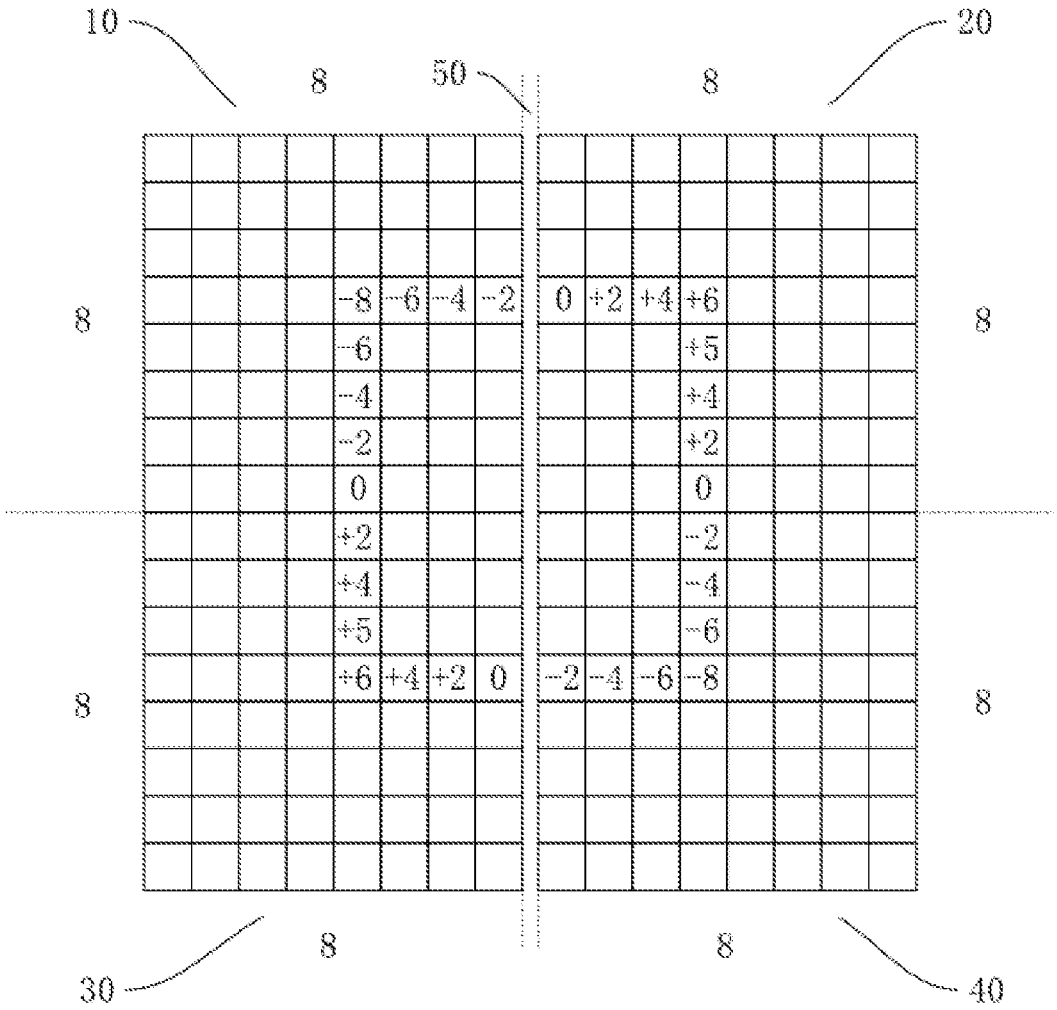
FIG. 2 is a schematic diagram of data compensation according to an embodiment of the present disclosure.
Figure 3:
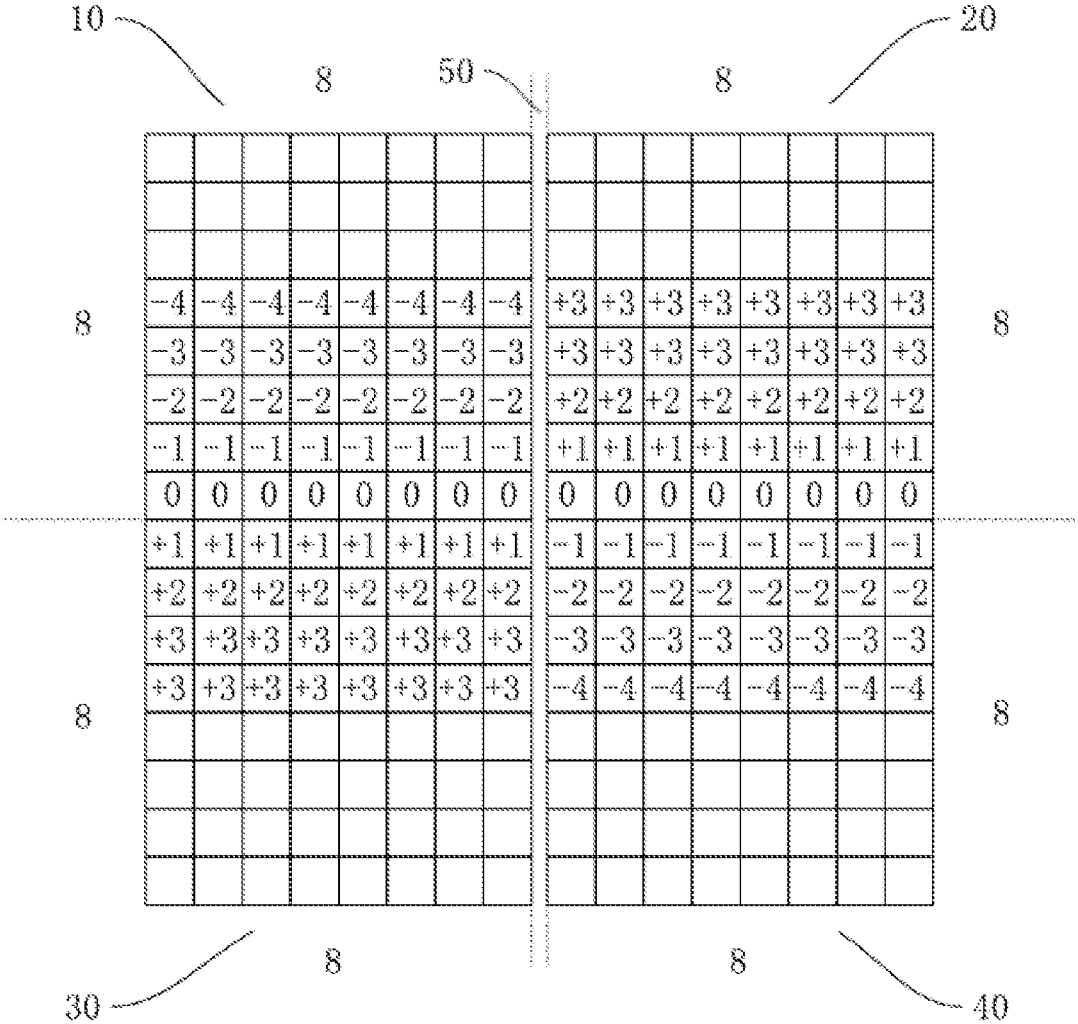
FIG. 3 is a schematic diagram of data compensation according to an embodiment of the present disclosure.

Please refer to FIGS. 2-3, which are schematic diagrams of data compensation according to an embodiment of the present disclosure and show compensating data for a part of the spliced partitions. In FIG. 2, instead of all of the initial compensation values, the initial compensation values for a part of the pixels in the spliced partitions acquired by steps S10 and S20 are shown. In FIG. 3, instead of all of the secondary compensation values, only a part of the secondary compensation values for the spliced partitions acquired by steps S30 and S40 are shown. In an embodiment of the present disclosure, a part of data is used for explanations, and the rest of the pixels can also be computed by referring to the embodiment of the present disclosure.

In addition, the spliced partitions in the drawings provided in an embodiment of the present disclosure include a first spliced partition 10, a second spliced partition 20, a third spliced partition 30, a fourth spliced partition 40, and a spliced line 50 located between the first spliced partition 10 and the second spliced partition 20 and between the third spliced partition 30 and the fourth spliced partition 40. In an embodiment of the present disclosure, taking a secondary compensation course of the pixels in four spliced partitions on two sides of the spliced line 50 as an example, a secondary compensation course of the pixels in the rest of the spliced partitions can be computed with reference to the compensation course of the four spliced partitions.

Multiple rows of pixels are arranged along a direction vertical to the spliced line 50 in each of the plurality of spliced partitions, each row of pixels corresponds to a central value which is an initial compensation value for a pixel located in the each row of pixels and in the middle of the each of the plurality of spliced partitions, and for the each row of pixels, the secondary compensation formula includes the central value to which the each row of pixels corresponds.

In addition, a secondary compensation value for each row of pixels is obtained by a corresponding central value according to the secondary compensation formula.

It needs to be stated that the central value is an initial compensation value for the middle pixel in a corresponding row of pixels. If there are two middle pixels, an initial compensation value for any of the two pixels is selected.

Specifically, please refer to FIG. 2, the data shown in the first spliced partition 10 represents initial compensation values for a part of the pixels in the first spliced partition 10. In an embodiment of the present disclosure, the central value shown in the first spliced partition 10 includes −8, −6, −4, −2, and 0. Also, in an embodiment of the present disclosure, the central value shown in the first spliced partition 10 is an initial compensation value for the 5th column of pixels reading from the left of the first spliced partition 10. In addition, an initial compensation value for each pixel in the 5th column is the central value of a corresponding row of pixels, that is, the initial compensation value for each pixel in the 5th column is the central value of a corresponding row of pixels.

In addition, according to practical conditions, the central value shown in the first spliced partition 10 can also be an initial compensation value for the 4th column of pixels reading from the left of the first spliced partition 10.

Likewise, the data shown in the second spliced partition 20 represents initial compensation values for a part of the pixels in the second spliced partition 20. In an embodiment of the present disclosure, the central value shown in the second spliced partition 20 includes +6, +5, +4, +2, and 0. Also, in an embodiment of the present disclosure, the central value shown in the second spliced partition 20 is an initial compensation value for the 4th column of pixels reading from the left of the second spliced partition 20. In addition, an initial compensation value for each pixel in the 4th column is the central value of a corresponding row of pixels, that is, the initial compensation value for each pixel in the 4th column is the central value of a corresponding row of pixels.

In addition, according to practical conditions, the central value shown in the second spliced partition 20 can also be an initial compensation value for the 5th column of pixels reading from the left of the second spliced partition 20.

The data shown in the third spliced partition 30 represents initial compensation values for a part of the pixels in the third spliced partition 30. In an embodiment of the present disclosure, the central value shown in the third spliced partition 30 includes +6, +5, +4, and +2. Also, in an embodiment of the present disclosure, the central value shown in the third spliced partition 30 is an initial compensation value for the 5th column of pixels reading from the left of the third spliced partition 30. In addition, an initial compensation value for each pixel in the 5th column is the central value of a corresponding row of pixels, that is, the initial compensation value for each pixel in the 5th column is the central value of a corresponding row of pixels.

In addition, according to practical conditions, the central value shown in the third spliced partition 30 can also be an initial compensation value for the 4th column of pixels reading from the left of the third spliced partition 30.

The data shown in the fourth spliced partition 40 represents initial compensation values for a part of the pixels in the fourth spliced partition 40. In an embodiment of the present disclosure, the central value shown in the fourth spliced partition 40 includes −8, −6, −4, and −2. Also, in an embodiment of the present disclosure, the central value shown in the fourth spliced partition 40 is an initial compensation value for the 4th column of pixels reading from the left of the fourth spliced partition 40. In addition, an initial compensation value for each pixel in the 4th column is the central value of a corresponding row of pixels, that is, the initial compensation value for each pixel in the 4th column is the central value of a corresponding row of pixels.

In addition, according to practical conditions, the central value shown in the fourth spliced partition 40 can also be an initial compensation value for the 5th column of pixels reading from the left of the fourth spliced partition.

Please refer to FIGS. 2-3, a secondary compensation value for the pixels in the four spliced partitions can be obtained according to the secondary compensation formula and the central value shown in the four spliced partitions.

Also, according to variations of the central value, the secondary compensation formula is represented under the following three conditions:

Firstly, when the central value is an even number, the secondary compensation formula is represented by: Z/2, where "Z" represents the central value.

Secondly, when the central value is an odd number and is greater than zero, the secondary compensation formula is represented by: (Z+1)/2, where "Z" represents the central value.

Thirdly, when the central value is an odd number and is less than zero, the secondary compensation formula is represented by: (Z−1)/2, where "Z" represents the central value.

As shown in FIG. 2, for example, the 5th column of the central values reading from the left of the first spliced partition 10 include −8, −6, −4, −2, and 0. Then, secondary compensation values for a row of pixels corresponding to each central value can be computed by selecting the above three conditions, and the acquired secondary compensation values are −4, −3, −2, −1, and 0 sequentially, as specifically shown in FIG. 3. Also, FIG. 3 only shows some regions corresponding to FIG. 2, and other regions can be computed by referring to the embodiment of the present disclosure.

As shown in FIG. 2, the 4th column of the central values reading from the left of the second spliced partition 20 include +6, +5, +4, +2, and 0. Then, secondary compensation values for a row of pixels corresponding to each central value can be computed by selecting the above three conditions, and the acquired secondary compensation values are +3, +3, +2, +1, and 0 sequentially, as specifically shown in FIG. 3. Also, FIG. 3 only shows some regions corresponding to FIG. 2, and other regions can be computed by referring to the embodiment of the present disclosure.

As shown in FIG. 2, the 5th column of the central values reading from the left of the third spliced partition 30 include +6, +5, +4, and +2. Then, secondary compensation values for a row of pixels corresponding to each central value can be computed by selecting the above three conditions, and the acquired secondary compensation values are +3, +3, +2, and +1 sequentially, as specifically shown in FIG. 3. Also, FIG. 3 only shows some regions corresponding to FIG. 2, and other regions can be computed by referring to the embodiment of the present disclosure.

As shown in FIG. 2, the 4th column of the central values reading from the left of the fourth spliced partition 40 include −8, −6, −4, and −2. Then, secondary compensation values for a row of pixels corresponding to each central value can be computed by selecting the above three conditions, and the acquired secondary compensation values are −4, −3, −2, and −1 sequentially, as specifically shown in FIG. 3. Also, FIG. 3 only shows some regions corresponding to FIG. 2, and other regions can be computed by referring to the embodiment of the present disclosure.

Also, the secondary compensation values for other spliced partitions can be computed with reference to the above computation course.

According to the above method, the secondary compensation values for the spliced partitions are computed, and the pixels in the spliced partitions are compensated for the second time, so that uniform compensation for the spliced display panel can be achieved. Also, a secondary compensation and a data compensation course of the initial compensation values can be adjusted at the same station without adding adjusting stations and time, so that process costs and process efficiency are saved.

In conclusion, the present disclosure provides a method of compensating a spliced display panel for a mura phenomenon to compute the initial compensation values through linear interpolation and to compensate all of the pixels. Then, the secondary compensation values are obtained according to a secondary compensation formula, the initial compensation values, and the above computing course in order that the pixels in the spliced partitions are compensated for the second time. Through compensating the spliced partitions for the second time, an embodiment of the present disclosure improves display uniformity of a spliced place of the spliced display panel, display effects of the spliced display panel, and product quality.

Figure 5:
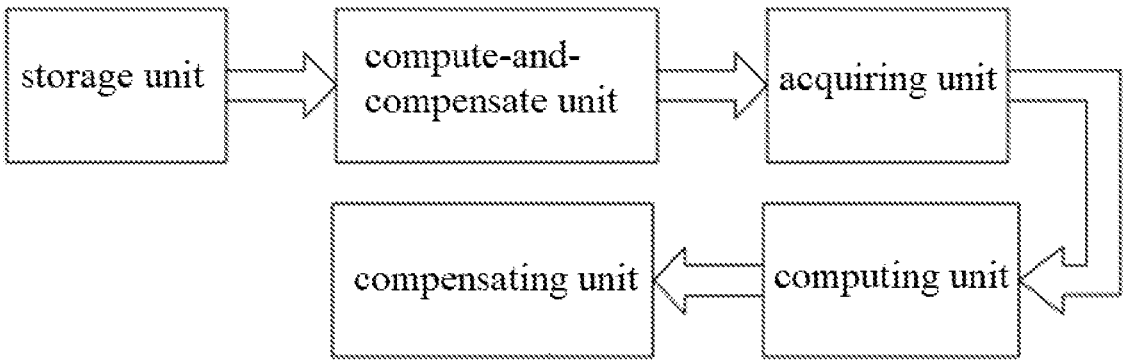
FIG. 5 is a unit structural diagram of a spliced display panel according to an embodiment of the present disclosure.

In addition, an embodiment of the present disclosure further provides a spliced display panel. Please refer to FIG. 5, which is a unit structural diagram of the spliced display panel according to an embodiment of the present disclosure.

The spliced display panel includes a storage unit, a compute-and-compensate unit, an acquiring unit, a computing unit, and a compensating unit.

The storage unit is configured to compress a plurality of partitions, each of which has n columns and m rows of pixels, where n and m are equal to 4 or are multiples of 4, and configured to store an initial compensation value for a first pixel in each of the plurality of partitions.

The compute-and-compensate unit is configured to compute, for the each of the plurality of partitions, initial compensation values for the pixels except the first pixel by linear interpolation according to initial compensation values for first pixels in adjacent partitions stored in the storage unit, and configured to compensate the spliced display panel for a mura phenomenon.

That is, the storage unit and the compute-and-compensate unit can finish a first grayscale data compensation for the spliced display panel.

The acquiring unit is configured to acquire initial compensation values for a plurality of spliced partitions, which are disposed close to two sides of a spliced line of the spliced display panel.

The computing unit is configured to obtain secondary compensation values for the plurality of spliced partitions according to a secondary compensation formula and the initial compensation values for the plurality of spliced partitions.

The compensating unit is configured to compensate the plurality of spliced partitions for a mura phenomenon for the second time according to the secondary compensation values.

That is, the acquiring unit, the computing unit, and the compensating unit can finish a second grayscale data compensation for the spliced display panel.

In an embodiment of the present disclosure, a compensation course of the pixels in the spliced display panel can be the same as the method of compensating the spliced display panel for a mura phenomenon in the above embodiments, so it is not repeated here.

In addition, the spliced display panel in an embodiment of the present disclosure can consist of a plurality of liquid crystal display panels spliced together and can be applied to various commercial and industrial display.

In conclusion, the present disclosure provides a spliced display panel and a method of compensating a spliced display panel for a mura phenomenon. After the spliced display panel is compensated for a mura phenomenon, pixels on two sides of a spliced line of the spliced display panel are compensated for the second time according to a secondary compensation formula and initial compensation values in order to improve display uniformity of a spliced place, a mura phenomenon in the spliced display panel, and display effects of the spliced display panel.

In the above embodiments, the description of each embodiment has individual point. A part of an embodiment not described in detail can be read with reference to related descriptions of other embodiments.

The spliced display panel and the method of compensating the spliced display panel for a mura phenomenon, provided in the embodiments of the present disclosure, are introduced in detail above. Specific embodiments are used for illustrating principles and implementation manners of the present disclosure. The descriptions of the above embodiments are merely used to understand the technical solutions and the core ideas of the present disclosure. It should be understood that a person of ordinary skill in the art can still make modifications corresponding to the technical solutions described in the above embodiments, or replace a part of technical features thereof equivalently. These modifications and replacement can not cause the essence of corresponding technical solutions to escape from the scope of the technical solutions described in the embodiments of the present disclosure.

What is claimed is:

1. A method of compensating a spliced display panel for a mura phenomenon, the method comprising:

defining a plurality of partitions, each of which has n columns and m rows of pixels, where n and m are equal to 4 or are multiples of 4, acquiring an initial compensation value for each of the pixels through a measuring device, and storing an initial compensation value for a first pixel in each of the plurality of partitions;

for the each of the plurality of partitions, computing initial compensation values for the pixels except the first pixel by linear interpolation according to initial compensation values for first pixels in adjacent partitions, and compensating the plurality of partitions for a mura phenomenon;

acquiring initial compensation values for pixels in a plurality of spliced partitions, which are disposed close to two sides of a spliced line of the spliced display panel; and obtaining secondary compensation values for the pixels in the plurality of spliced partitions according to a secondary compensation formula and the initial compensation values for the pixels in the plurality of spliced partitions in order to compensate the plurality of spliced partitions for a mura phenomenon for the second time, wherein multiple rows of pixels are arranged along a direction vertical to the spliced line in each of the plurality of spliced partitions, each row of pixels corresponds to a central value which is an initial compensation value for a pixel located in the each row of pixels and in the middle of the each of the plurality of spliced partitions, and for the each row of pixels, the secondary compensation formula comprises the central value to which the each row of pixels corresponds.

2. The method of claim 1, wherein a secondary compensation value for the each row of pixels is obtained by a corresponding central value according to the secondary compensation formula.

3. The method of claim 1, wherein when the central value is an even number, the secondary compensation formula is represented by: Z/2, where "Z" represents the central value.

4. The method of claim 1, wherein when the central value is an odd number and is greater than zero, the secondary compensation formula is represented by: (Z+1)/2, where "Z" represents the central value.

5. The method of claim 1, wherein when the central value is an odd number and is less than zero, the secondary compensation formula is represented by: (Z−1)/2, where "Z" represents the central value.

6. The method of claim 1, wherein the central value is an initial compensation value for any of two middle pixels in a corresponding row of pixels.

7. The method of claim 1, wherein n is equal to m.

* * * * *